US005551838A

United States Patent [19]

Hugbart

[11] Patent Number: 5,551,838

[45] Date of Patent: Sep. 3, 1996

[54] INLET BELL FOR CENTRIFUGAL FANS

[75] Inventor: Jean-Paul Hugbart, Rully, France

[73] Assignee: ABB Flakt AB, Stockholm, Sweden

[21] Appl. No.: 406,975

[22] PCT Filed: Sep. 24, 1993

[86] PCT No.: PCT/SE93/00772

§ 371 Date: Mar. 29, 1995

§ 102(e) Date: Mar. 29, 1995

[87] PCT Pub. No.: WO94/08144

PCT Pub. Date: Apr. 14, 1994

[30] Foreign Application Priority Data

Oct. 1, 1992 [SE] Sweden ..... 9202850

[51] Int. Cl.[6] ..... F04D 29/44

[52] U.S. Cl. ..... 415/206; 415/208.1

[58] Field of Search ..... 415/204, 206, 415/208.1, 223, 58.3

[56] References Cited

U.S. PATENT DOCUMENTS

| | | | |
|---|---|---|---|
| 1,612,568 | 12/1926 | Buder . | |
| 1,787,652 | 1/1931 | Anderson | 415/204 |
| 2,209,607 | 7/1940 | Nutting | 415/204 |
| 3,101,890 | 8/1963 | Carlson | 415/223 |
| 3,627,440 | 12/1971 | Wood | 415/206 |

FOREIGN PATENT DOCUMENTS

| | | |
|---|---|---|
| 4023724 | 4/1991 | Germany . |
| 4020236 | 1/1992 | Germany . |
| 2017823 | 10/1979 | United Kingdom . |

*Primary Examiner*—James Larson
*Attorney, Agent, or Firm*—Burns, Doane, Swecker & Mathis, L.L.P.

[57] ABSTRACT

Inlet bell for centrifugal fans having an impeller (15, 24) with a cover plate (14, 23), the inlet bell opening into the cover plate with an intervening gap (I) for recirculation air, wherein the inlet bell (11, 20) is provided with a conical inlet part (12, 21), tapering towards the impeller (15, 24), and a mouthpiece (13, 22) connected to the inlet part, and in that a circular flow guide (16, 23) is arranged at the intersection between the inlet part and the mouthpiece of the inlet bell.

20 Claims, 3 Drawing Sheets

INLET BELL FOR CENTRIFUGAL FANS

The present invention refers to a novel inlet bell for centrifugal fans having an impeller with a cover plate with a circular inlet opening, the inlet bell opening into the cover plate with an intervening gap for recirculated air.

PRIOR ART

Many shapes have already been designed and used for inlet bells of centrifugal fans. Those shapes are designed either for good performances of the fan or for minimum cost.

For obtaining a good performance prior art inlet bells have been made very smooth by manufacturing the pieces using spinning technique. This makes the inlet bells very expensive. In FIG. 1 an inlet bell of this kind is shown, with an outlet end manufactured using spinning technique, opening into the impeller of a centrifugal fan.

Where these high costs are not accepted, simple constructions with an inlet bell in the form of a cylinder, as in FIG. 2, or as a cone, as in FIG. 3, have been used with a resulting poor performance. This is due to undesirable eddies formed in the recirculation area adjacent the inlet of the impeller coverplate.

BRIEF DESCRIPTION OF THE INVENTION

The object of the invention is to provide an inlet bell with a good performance and at the same time a low manufacturing cost.

This is accomplished with the inlet bell according to the invention, which is characterized in that the inlet bell is provided with a conical inlet part, tapering towards the impeller, and a mouthpiece connected to the inlet part, and in that a circular flow guide means is arranged at the intersection between the inlet part and the mouthpiece of the inlet bell.

With this arrangement according to the invention a fairly good performance is achieved at a very reasonable manufacturing cost for the inlet bell. The object of the flow guide means is to obtain a separation of the flow from the inlet part of the bell with as small a disturbance of the flow as possible.

The flow guide means could be realized in several different ways.

According to a first embodiment of the invention the flow guide means is a protruding lip formed inside the mouthpiece by the tapering end of the inlet cone, which is partly inserted into the mouthpiece.

The performance may be further enhanced by providing a chamfered or rounded edge of the protruding lip, and/or forming the lip with a small curvature at the edge. With this arrangement the point where the flow separates from the surface is fixed. The costs for the chamfering or rounding the edge and the forming of a small curvature on the edge of a cylinder or cone is very low and easily done.

According to a preferred embodiment of the invention the conical inlet part has a cone angle $\alpha$ of between 25° and 50° in order to give the desired airflow into the fan.

According to a further embodiment of the invention the mouthpiece has the form of a cylinder. Preferably the ratio between the diameter of the circular flow guide means and the mouthpiece diameter d/D (see FIG. 5) lies between 0,8 and 1, and the ratio between the length of the mouthpiece 1 and the mouth piece diameter D between 0,1 and 0,28.

According to another embodiment of the invention the mouthpiece has a conical outwardly tapering form, the flow guide means being a protruding lip formed inside the mouthpiece by the tapered end of the inlet part, which is partly inserted into the mouthpiece.

According to still another embodiment of the invention the mouthpiece has a conical outwardly tapering form, the flow guide means being the edge formed between the two conical parts secured to each other at their respective narrow ends, the angle ($\beta$) being at least 230°.

One advantage of the conical mouthpiece is that it provides a low resistance to the recirculating flow entering through the gap between the inlet mouthpiece and the impeller coverplate. This recirculating flow maintains pressure stability of the fan and can increase the pressure.

As in the case of the protruding lip, the outlet edge of the mouthpiece can be chamfered or rounded and/or might have a small curvature in order to further enhance the flow characteristics and to fix the point where the flow separates from the surface.

BRIEF DESCRIPTION OF THE DRAWINGS

The invention will be explained more in detail in the following description of embodiments of the invention illustrated in the accompanying drawings, in which.

DESCRIPTION OF PREFERRED EMBODIMENTS OF THE INVENTION

Figure 1:
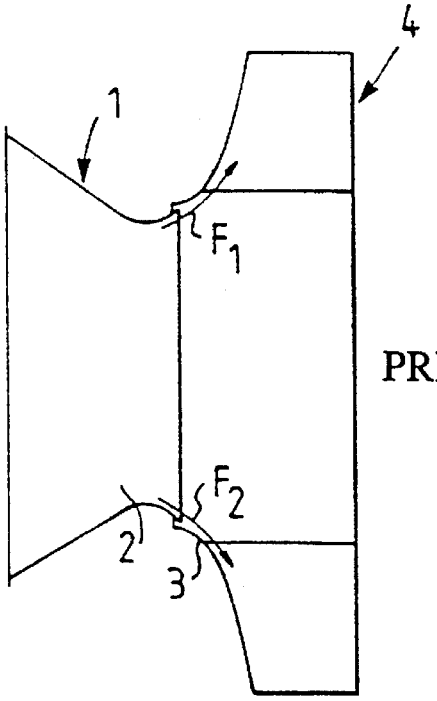
PRIOR ART FIG. 1
FIGS. 1–3 are schematic cross sectional views of prior art inlet bells, discussed in the introductory part of the description.

In FIG. 1 a prior art type inlet bell 1 is shown with a smooth rounded outlet part 2 opening into a coverplate 3 of the impeller 4. This results in a very good performance with undisturbed flow indicated with arrows $F_1$, but, as discussed above, this part will be quite expensive.

Figure 2:
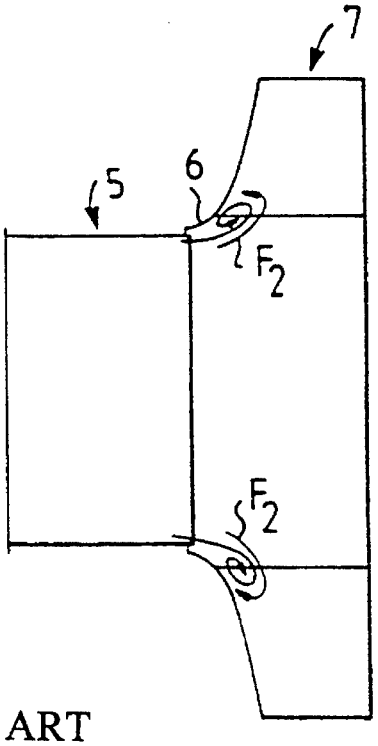
PRIOR ART FIG. 2
Figure 3:
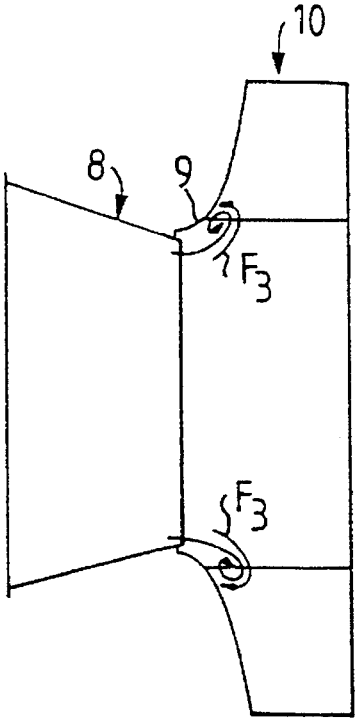
PRIOR ART FIG. 3

In FIG. 2 the inlet bell 5 is cylindrical, which is a very inexpensive solution, but the performance is poor, as illustrated with eddies $F_2$ formed along the inside wall of the coverplate 6 of the impeller 7. The same result is obtained with a conical inlet bell 8 opening into the coverplate 9 of the impeller 10 as illustrated with arrows $F_3$ in FIG. 3.

Figure 4:
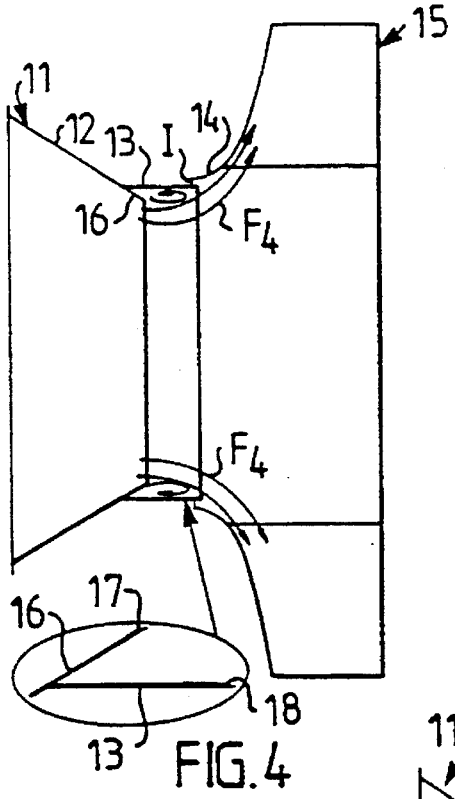
FIG. 4 is a schematic cross sectional view of one embodiment of the inlet bell according to the invention, also showing part of the inlet bell in an enlarged scale.

In FIG. 4, a first embodiment of the invention is shown. The inlet bell 11 has a conical inlet 12 and a cylindrical mouthpiece 13, which opens into a coverplate 14 of the impeller 15. The conical inlet 12 protrudes into the mouthpiece 13 and the two parts are welded together or combined in any other suitable way. The part of the inlet cone 12 protruding into the mouthpiece forms a lip 16 acting as a flow guide means. According to the enlarged view in FIG. 4 of the lip and the adjacent parts of the inlet cone and the mouthpiece, the edge 17 of the lip is chamfered as is also the edge 18 of the mouthpiece. With this arrangement the point where the flow separates from the surface is fixed. The flow is illustrated with arrows $F_4$, showing that eddies will form downstream the flow separation point. The main flow will pass over these eddies substantially undisturbed, resulting in a good performance. The length of the lip is a function of flow velocity and may be determined during model tests for optimum performance. Critical dimensions will be discussed more in detail in connection with the description of FIG. 5.

Figure 5:
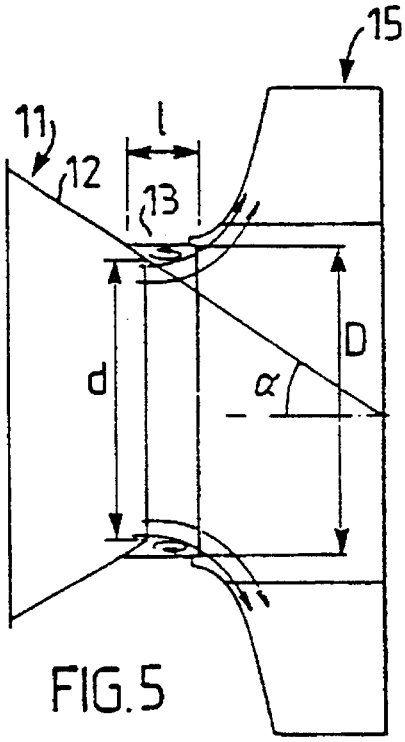
FIG. 5 is a view corresponding to FIG. 4 showing important characteristic dimensions of the inlet bell.

In FIG. 5, the important geometrical dimensions are inserted. The cone angle $\alpha$ of the conical inlet should be kept within the interval $25°<\alpha<50°$. The diameter of the flow guide means, i.e. the lip 16, which is the diameter of the smaller opening of the conical inlet "d" should be less or equal to the diameter "D" of the cylinder acting as the mouthpiece of the inlet bell, and preferably the ratio d/D should be kept within the interval 0,8–1. Finally, the length "1" of the cylinder should stand in a relation to the diameter "D" of the cylinder such that $0,1<1/D<0,28$.

Figure 6:
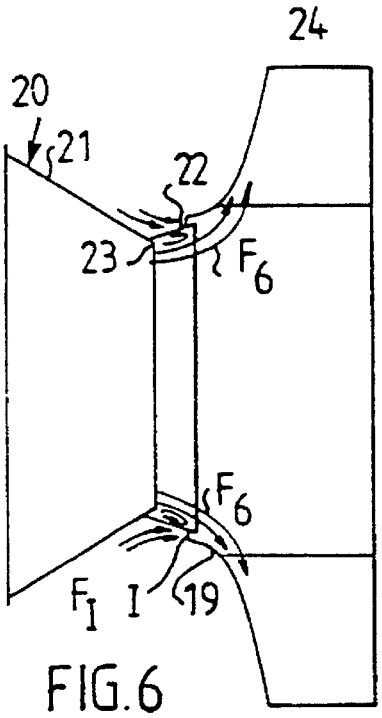
FIG. 6 is a schematic cross sectional view of a second embodiment of the inlet bell according to the invention, FIGS. 6*a* and 6*b* showing part of the inlet bell in two different configurations in an enlarged scale.
Figure 6A:
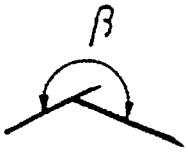
Figure 6B:
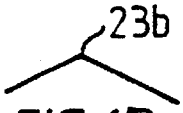

In FIG. 6 another embodiment of the invention is shown. The inlet bell 20 comprises a conical inlet 21 getting narrower in the direction of the flow and a conical mouthpiece 22 getting wider in said direction, which parts are welded or otherwise connected to each other with a lip 23 formed as according to the FIG. 4 embodiment, or an edge **23*b*, see FIG. 6*b*. With a cone angle between 25° and 50° for each of said two conical parts, the angle $\beta$ between the walls of the two conical parts, see FIG. 6*a*, will be at least 230° which is sufficient for the separation of the flow from the surface at the connection point between the two parts, and the edge 23*b* formed will act as the flow guide means. Hence there need not be a protruding lip. The angle $\beta$ is illustrated in FIG. 6*a* and the embodiment without a protruding lip is illustrated in FIG. 6*b***.

In the embodiment according to FIG. 6 the conical mouthpiece 22 gives the advantage of a low resistance to the recirculating flow $F_I$ in the recirculation area "I" between the inlet mouthpiece 22 and the inner part of the coverplate 19 of the impeller 24. This recirculating flow maintains pressure stability of the fan and can increase the pressure. This embodiment also results in a good performance, as discussed above, and which is shown with arrows $F_6$ illustrating the flow.

As is discussed above, the configuration of the different parts of the inlet bell according to the invention can be varied for obtaining the best possible performance at a low manufacturing cost.

Figure 7A:
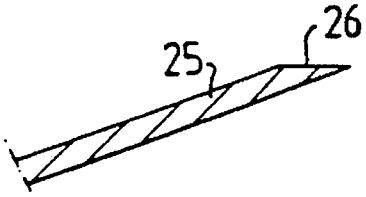
FIGS. 7*a* and 7*b* are fragmentary views showing two different embodiments of the flow guide means.
Figure 7B:
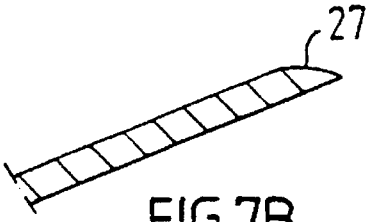

As an example, in FIG. **7*a* wherein part of a protruding lip 25 is shown, the outer edge 26 is chamfered on one side and according to FIG. 7*b* the edge 27** is rounded. These two alternatives will give substantially the same effect.

Figure 8A:
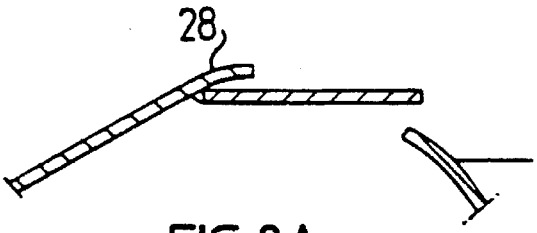
FIGS. 8*a*, 8*b* and 8*c* are fragmentary views showing different configurations of the flow guide means and the outlet end of the mouthpiece.
Figure 8B:
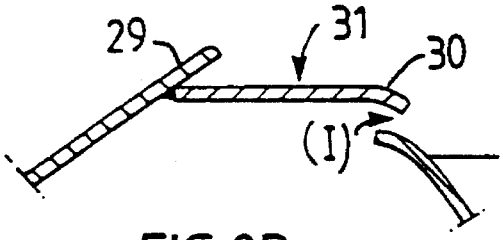
Figure 8C:
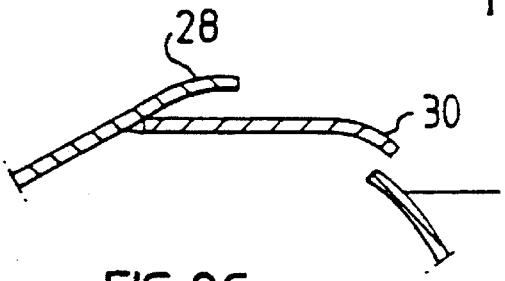

In FIG. **8*a*, a protruding lip 28 is shown, having a small curvature, which is realized easily and cheaply by widening the narrow part of the inlet cone. In FIG. 8*b* a protruding lip 29 is shown being straight while the outer edge 30 of the cylindrical mouthpiece 31 has a small curvature. This will amplify the pressure stabilising effect in the recirculation area "I" by improving the flow characteristics for the recirculation air as well as the air coming through the inlet bell according to the invention. In FIG. 8*c* an embodiment, in which the protruding lip 28 having a small curvature and the edge of the mouthpiece 30** having a small curvature, is illustrated. These embodiments can also be used in connection with a conical mouthpiece.

I claim:

1. Inlet bell for a centrifugal fan, the centrifugal fan having an impeller with a cover plate, the inlet bell having an inlet end and an outlet end, the outlet end opening into the cover plate of the centrifugal fan, the outlet end and the cover plate defining a gap for recirculation air, the inlet bell comprising:

a conical inlet part having an inlet end and an outlet end, the inlet part being inwardly tapered toward the outlet end of the inlet part; and a mouthpiece having an inlet end and an outlet end, the mouthpiece being connected, at its inlet end, to the outlet end of the inlet part, the outlet end of the inlet part being partly inserted into inlet end of the mouthpiece to define a circular lip, the lip being disposed at an intersection between the inlet part and the mouthpiece.

2. Inlet bell according to claim 1, wherein the lip is chamfered or rounded on one side.

3. Inlet bell according to claim 2, wherein the lip terminates with a curvature in a direction of flow.

4. Inlet bell according to claim 2, wherein the mouthpiece is conical, the outlet end of the mouthpiece being larger than the inlet end of the mouthpiece.

5. Inlet bell according to claim 2, wherein an edge of the mouthpiece by the outlet end of the mouthpiece is chamfered or rounded on one side.

6. Inlet bell according to claim 2, wherein an edge of the mouthpiece by the outlet end of the mouthpiece terminates with a curvature.

7. Inlet bell according to claim 1, wherein the lip terminates with a curvature in a direction of flow through the inlet bell.

8. Inlet bell according to claim 7, wherein the mouthpiece is conical, the outlet end of the mouthpiece being larger than the inlet end of the mouthpiece.

9. Inlet bell according to claim 7, wherein an edge of the mouthpiece by the outlet end of the mouthpiece is chamfered or rounded on one side.

10. Inlet bell according to claim 7, wherein an edge of the mouthpiece by the outlet end of the mouthpiece terminates with a curvature.

11. Inlet bell according to claim 1, wherein the mouthpiece is conical, the outlet end of the mouthpiece being larger than the inlet end of the mouthpiece.

12. Inlet bell according to claim 11, wherein an edge of the mouthpiece by the outlet end of the mouthpiece is chamfered or rounded on one side.

13. Inlet bell according to claim 11, wherein an edge of the mouthpiece by the outlet end of the mouthpiece terminates with a curvature.

14. Inlet bell according to claim 1, wherein an edge of the mouthpiece by the outlet end of the mouthpiece is chamfered or rounded on one side.

15. Inlet bell according to claim 14, wherein an edge of the mouthpiece by the outlet end of the mouthpiece terminates with a curvature.

16. Inlet bell according to claim 1, wherein an edge of the mouthpiece by the outlet end of the mouthpiece terminates with a curvature.

17. Inlet bell for a centrifugal fan, the centrifugal fan having an impeller with a cover plate, the inlet bell having an inlet end and an outlet end, the outlet end opening into the cover plate of the centrifugal fan, the outlet end and the cover plate defining a gap for recirculation air, the inlet bell comprising:

a conical inlet part having an inlet end and an outlet end, the inlet part being inwardly tapered toward the outlet end of the inlet part; and a mouthpiece having an inlet end and an outlet end, the mouthpiece being connected, at its inlet end, to the outlet end of the inlet part, the mouthpiece being conical, the outlet end of the mouthpiece being larger than the inlet end of the mouthpiece, an angle between walls of the mouthpiece and the inlet part being at least 230°.

18. Inlet bell according to claim 17, wherein an edge of the mouthpiece by the outlet end of the mouthpiece is chamfered or rounded on one side.

19. Inlet bell according to claim 18, wherein an edge of the mouthpiece by the outlet end of the mouthpiece terminates with a curvature.

20. Inlet bell according to claim 17, wherein an edge of the mouthpiece by the outlet end of the mouthpiece terminates with a curvature.

* * * * *